US008403327B2

(12) United States Patent
Fischer et al.

(10) Patent No.: US 8,403,327 B2
(45) Date of Patent: Mar. 26, 2013

(54) COLLAPSIBLE GAME

(75) Inventors: Jeremy R. Fischer, Long Beach, CA (US); Tyler Kenney, Redondo Beach, CA (US); Sammy Wai Nang Lam, Kowloon (HK)

(73) Assignee: Mattel, Inc., El Segundo, CA (US)

( * ) Notice: Subject to any disclaimer, the term of this patent is extended or adjusted under 35 U.S.C. 154(b) by 318 days.

(21) Appl. No.: 12/765,186

(22) Filed: Apr. 22, 2010

(65) Prior Publication Data

US 2011/0198808 A1 Aug. 18, 2011

Related U.S. Application Data

(60) Provisional application No. 61/304,465, filed on Feb. 14, 2010.

(51) Int. Cl.
*A63F 7/04* (2006.01)

(52) U.S. Cl. ..... 273/144 R

(58) Field of Classification Search ..... 273/144 R
See application file for complete search history.

(56) References Cited

U.S. PATENT DOCUMENTS

| | | | | |
|---|---|---|---|---|
| 770,621 | A | 9/1904 | Kim et al. | |
| 1,020,347 | A * | 3/1912 | Follett | 220/8 |
| 1,202,582 | A | 10/1916 | Poling | |
| 1,436,499 | A | 11/1922 | Hammond | |
| 1,451,622 | A | 4/1923 | Marston | |
| 2,299,182 | A | 10/1942 | Schoof | |
| 2,880,902 | A | 4/1959 | Owsen | |
| 3,083,877 | A | 4/1963 | Gash | |
| 3,114,468 | A | 12/1963 | Quase | |
| 3,114,548 | A | 12/1963 | Taft, Jr. | |
| 3,220,544 | A | 11/1965 | Lovell | |
| 3,285,459 | A | 11/1966 | Gahm | |
| 3,286,872 | A | 11/1966 | Burdick, Jr. | |
| 3,329,298 | A | 7/1967 | Demas | |
| 3,578,320 | A * | 5/1971 | Goldfarb et al. | 273/459 |
| 3,617,057 | A | 11/1971 | Goldfarb et al. | |
| 3,771,790 | A * | 11/1973 | Kong | 273/110 |
| 3,939,888 | A | 2/1976 | Scamato | |
| 4,087,090 | A | 5/1978 | Goldberg | |
| 4,108,431 | A | 8/1978 | Camara | |
| 4,492,313 | A | 1/1985 | Touzani | |
| 4,596,340 | A | 6/1986 | Luther | |
| 4,624,382 | A | 11/1986 | Tontarelli | |
| 4,869,382 | A | 9/1989 | Thompson | |
| 4,875,576 | A | 10/1989 | Torgrimson et al. | |
| 4,955,493 | A | 9/1990 | Touzani | |
| 4,978,021 | A | 12/1990 | Mini et al. | |
| 5,197,735 | A * | 3/1993 | Land et al. | 273/144 R |
| 5,226,551 | A | 7/1993 | Robbins, III | |
| 5,370,391 | A * | 12/1994 | Hilzendeger et al. | 273/118 R |

(Continued)

OTHER PUBLICATIONS

Document entitled "NPLSubmission20081103" showing information disclosed to the Assignee by a non-inventor on Nov. 3, 2008, 3 pages.

(Continued)

*Primary Examiner* — Kurt Fernstrom
*Assistant Examiner* — Dolores Collins
(74) *Attorney, Agent, or Firm* — Edell, Shapiro & Finnan LLC

(57) ABSTRACT

A collapsible game is disclosed. In one embodiment, the game includes a divider and multiple outlets to obtain random distribution of objects in the game. The game also includes a movably coupled lid that can be moved relative to the opening of the game. The lid includes a finger recess that facilitates movement of the lid.

19 Claims, 15 Drawing Sheets

U.S. PATENT DOCUMENTS

| | | | | |
|---|---|---|---|---|
| 5,392,941 | A | 2/1995 | Robbins, III | |
| 5,393,060 | A * | 2/1995 | Land | 273/138.3 |
| 5,533,638 | A | 7/1996 | Robbins, III | |
| 5,562,518 | A | 10/1996 | Estrada | |
| 5,575,398 | A | 11/1996 | Robbins, III | |
| 5,579,940 | A | 12/1996 | Weiss et al. | |
| 5,584,413 | A | 12/1996 | Jung | |
| 5,632,406 | A | 5/1997 | Robbins, III | |
| 5,632,490 | A | 5/1997 | Brown | |
| 5,707,062 | A * | 1/1998 | Perillo et al. | 273/354 |
| 5,782,372 | A | 7/1998 | Weiss et al. | |
| 5,860,556 | A | 1/1999 | Robbins, III | |
| 5,862,932 | A | 1/1999 | Walsh et al. | |
| 5,878,903 | A | 3/1999 | Ung | |
| 5,911,338 | A | 6/1999 | Miller | |
| 5,967,875 | A | 10/1999 | Graef | |
| 6,116,448 | A | 9/2000 | Fragos | |
| 6,412,652 | B1 | 7/2002 | Woram et al. | |
| 6,666,329 | B1 | 12/2003 | Charbonneau | |
| 6,736,285 | B2 * | 5/2004 | Stewart-Stand | 220/666 |
| 6,843,478 | B1 * | 1/2005 | Hoepelman | 273/342 |
| 7,285,034 | B2 * | 10/2007 | Kay et al. | 446/73 |
| 7,458,480 | B2 * | 12/2008 | Nguyen | 220/666 |
| 7,618,302 | B2 * | 11/2009 | Collins et al. | 446/174 |
| 7,651,097 | B2 * | 1/2010 | Kay et al. | 273/294 |
| 7,661,525 | B1 * | 2/2010 | Sandy | 206/218 |
| 2002/0039609 | A1 | 4/2002 | Bezek et al. | |
| 2003/0183628 | A1 | 10/2003 | Barr | |
| 2004/0169039 | A1 | 9/2004 | Freeman | |
| 2004/0169040 | A1 | 9/2004 | Berbrich et al. | |
| 2004/0232016 | A1 | 11/2004 | Dietrich | |
| 2005/0017457 | A1 * | 1/2005 | Dubinsky | 273/440 |
| 2005/0245168 | A1 | 11/2005 | Kay et al. | |
| 2007/0072516 | A1 | 3/2007 | Liff et al. | |
| 2008/0179323 | A1 | 7/2008 | Circosta et al. | |

OTHER PUBLICATIONS

Document entitled "NPLSubmission20081210" showing information disclosed to the Assignee by a non-inventor on Dec. 10, 2008, 5 pages.

Document entitled "NPLSubmission20090209" showing information disclosed to the Assignee by a non-inventor on Feb. 9, 2009 and Feb. 11, 2009, 3 pages.

* cited by examiner

COLLAPSIBLE GAME

CROSS-REFERENCE TO RELATED APPLICATION

This application claims priority to and the benefit of U.S. Provisional Patent Application No. 61/304,465, filed Feb. 14, 2010, entitled "Collapsible Game," the entire disclosure of which is incorporated herein by reference in its entirety.

FIELD OF THE INVENTION

The present invention relates to a game, and in particular, to a collapsible game. The invention also relates to collapsible game with the capability to store one or more of the game components. In addition, the invention also relates to features of the game that facilitate game play.

BACKGROUND OF THE INVENTION

A game that involves the dropping of objects onto rods and the subsequent removal of rods is disclosed in U.S. Pat. No. 3,578,320 to Goldfarb, et al., the entire disclosure of which is incorporated by reference herein for all purposes. The game disclosed in the '320 patent is also known by the name "KERPLUNK."

Notably, the conventional game does not have any storage capability for the pieces of the game. In addition, the conventional game does not have any adjustability that would facilitate transporting and stowing of the game. Moreover, the conventional game only has a single output for objects falling during play of the game, making the exit of the objects predictable. Also, the conventional game does not include any features that provide access to an inlet for the game during game play and yet can be used to retain objects within the game during transportation or storage of the game.

There is a need for a game that is easily portable and provides for convenient storage of the pieces of the game. There is also a need for a game with an improved distribution of objects from the game. In addition, there is a need for a game that is easy to use in its collapsed configuration and deployed configuration.

SUMMARY OF THE INVENTION

In one embodiment, a game includes a reconfigurable housing having a first cap including a body defining an opening therethrough; a second cap defining a receptacle; and a passage portion having a first end and a second end, the first end being coupled to the first cap and the second end being coupled to the second cap, the passage portion being reconfigurable between a collapsed configuration and a deployed configuration, the passage portion defining a channel in communication with the opening in the first cap, and having a first outlet and a second outlet, each of the outlets being in communication with the receptacle of the second cap; at least one elongate member configured to be inserted into and supported by the passage portion, the at least one elongate member extending into the channel; and at least one object configured to be inserted into the opening of the first cap, the at least one object traveling from the opening in the first cap, through the channel of the passage portion, and out one of the outlets into the receptacle of the second cap.

In an alternative embodiment, the first cap includes a lid movably coupled to the body of the first cap, the lid being positionable to cover the opening. Alternatively, the first cap includes a recess that facilitates movement of the lid relative to the first cap. Also, the lid includes a recess that facilitates movement of the lid relative to the first cap.

In an alternative embodiment, the passage portion includes a divider located between the first outlet and the second outlet. In one implementation, the divider includes a ridge, a first guide surface, and a second guide surface, the ridge being located between the first guide surface and the second guide surface. Also, the first guide surface is located proximate to the first outlet and the second guide surface is located proximate to the second outlet.

In an alternative embodiment, the at least one elongate member includes a body with a engagement member formed thereon, the engagement member engaging a portion of the passage portion to limit the movement of the at least one elongate member relative to the passage portion. The engagement member can be a first engagement member and the at least one elongate member includes a second engagement member formed on the body, the second engagement member being spaced apart from the first engagement member.

In an alternative embodiment, the passage portion includes a first section and a second section coupled to the first section in a telescopic arrangement, and one of the first section and the second section being configured to provide a snap fit when the first section and the second section are moved to extended positions, the snap fit retaining the first section and the second section in their extended positions.

In an alternative embodiment, the first cap includes a lid pivotally coupled to the body of the first cap, the lid being movable between an opened position and a closed position in which it covers the opening, each of the lid and the body of the first cap including a recess formed therein, the recesses being configured to receive a user's finger.

In one embodiment, a collapsible game includes a housing reconfigurable between a collapsed configuration and a deployed configuration, the housing having a first housing portion including a body with an opening therethrough, the body having a recess formed therein, the first housing portion having a lid pivotally coupled to the body, the lid having a recess formed therein, the recesses being proximate to each other when the lid is in a closed position relative to the first housing portion; a second housing portion defining a receptacle; and a passage portion including a wall and having a first end coupled to the first housing portion and a second end coupled to the second housing portion, the passage portion supporting the first housing spaced apart from the second housing when the housing is in its deployed configuration, the passage portion having a channel in communication with the opening in the first housing portion and extending to an outlet proximate to the second end, the passage portion including a plurality of openings formed in the wall; at least one elongate member configured to be inserted into one of the openings formed in the wall, the at least one elongate member extending into the channel; and at least one object configured to be inserted into the opening of the first housing portion, the at least one object traveling from the opening in the first housing portion, through the channel of the passage portion proximate to the at least one elongate member, and out of the outlet into the receptacle of the second housing portion.

In an alternative embodiment, each of the recesses is configured to be engaged by a finger of a user. Alternatively, the outlet of the passage portion is a first outlet and the passage portion includes a second outlet, each of the first outlet and the second outlet being in communication with the receptacle of the second housing portion such that the at least one object can travel out of either the first outlet or the second outlet into the receptacle of the second housing portion. Each of the recesses is configured to be engaged by a finger of a user.

In an alternative embodiment, the passage portion includes a divider located proximate to the channel, the divider being configured to direct the at least one object toward the first outlet or the second outlet. The divider may include a first guide surface, a second guide surface, and a divider located between the guide surfaces, each of the guide surfaces being oriented toward one of the outlets. Also, the passage portion includes a plurality of sections, each of the sections including a coupling structure that engages an adjacent section and maintains the passage portion in a deployed configuration when the housing is in its deployed configuration.

In one embodiment, a collapsible game includes an upper housing; a lower housing; a passage portion coupled to the upper housing and to the lower housing, the passage portion being disposable in a deployed configuration and in a collapsed configuration, the passage portion in its deployed configuration having a greater length than in its collapsed configuration, the passage portion including a first opening proximate to the upper housing, a second opening proximate to the lower housing, and a third opening proximate to the lower housing, the passage portion including a divider located between the second opening and the third opening; and at least one object configured to be inserted into the first opening when the passage portion is in its deployed configuration, engage the divider, and exit the second opening or the third opening.

In an alternative embodiment, the passage portion includes a wall with at least one opening, and the game includes at least one elongate member insertable into the at least one opening of the wall, the at least one elongate member including an engagement member formed thereon, the engagement member preventing the at least one elongate member from disengaging from the passage portion, the at least one object being engageable with the at least one elongate member when the at least one object moves through the passage portion.

BRIEF DESCRIPTION OF THE DRAWINGS

Like reference numerals have been used to identify like elements throughout this disclosure.

DETAILED DESCRIPTION OF THE INVENTION

Figure 1A:
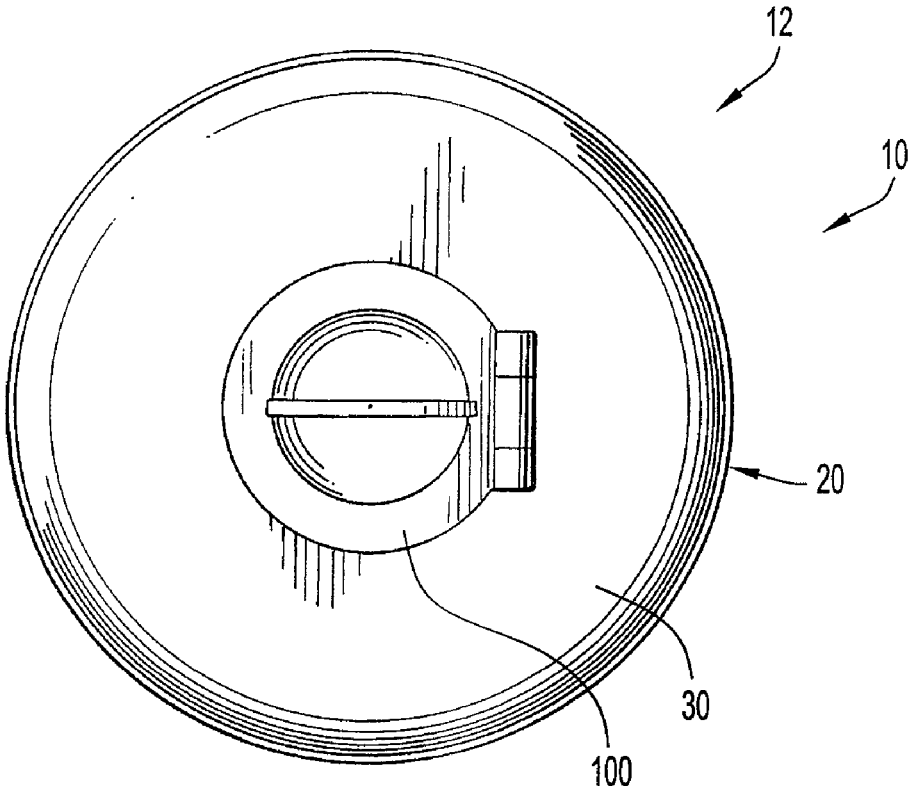
FIG. 1A illustrates a top view of an embodiment of the housing of the game in a collapsed configuration.
Figure 1B:
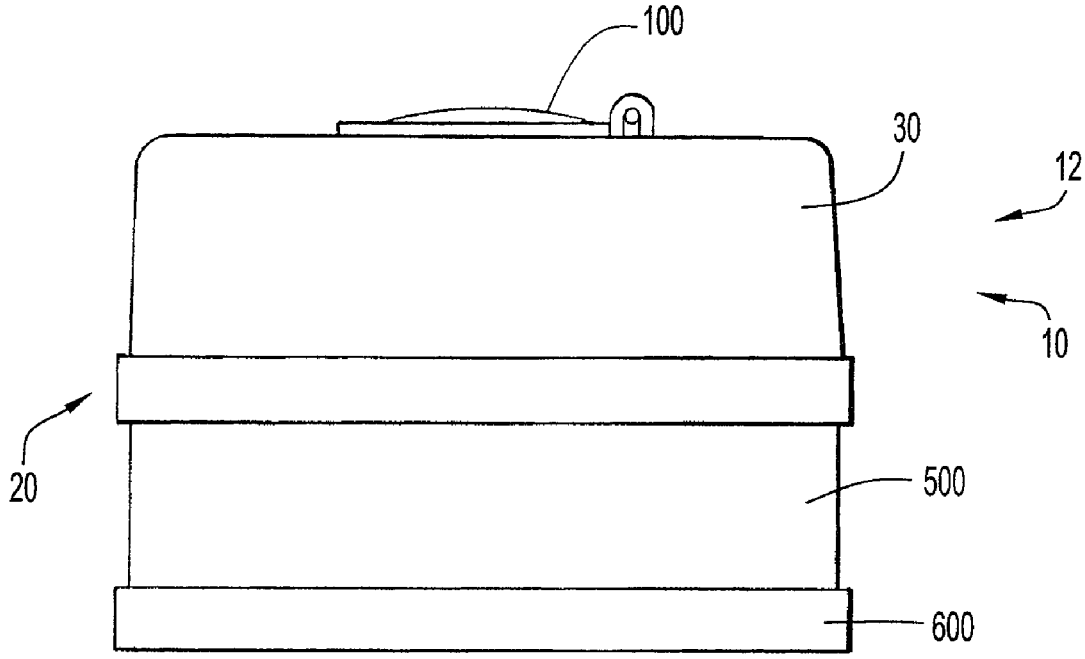
FIG. 1B illustrates a side view of the housing illustrated in FIG. 1A.

Referring to FIGS. 1A and 1B, an embodiment of a game is illustrated. In this embodiment, the game 10 is reconfigurable between a collapsed configuration and a deployed configuration. In FIGS. 1A and 1B, the game 10 is illustrated in its collapsed configuration 12. The game 10 includes a housing 20 that includes an upper cap or housing portion 30 and a lower cap or housing portion 500. Coupled to the upper housing portion 30 is a lid 100, which is described in greater detail below. The lid 100 is shown in its closed position in FIGS. 1A and 1B. The housing 20 also includes a lower or bottom lid or cover 600 that is removably coupled to the lower cap 500.

Figure 2:
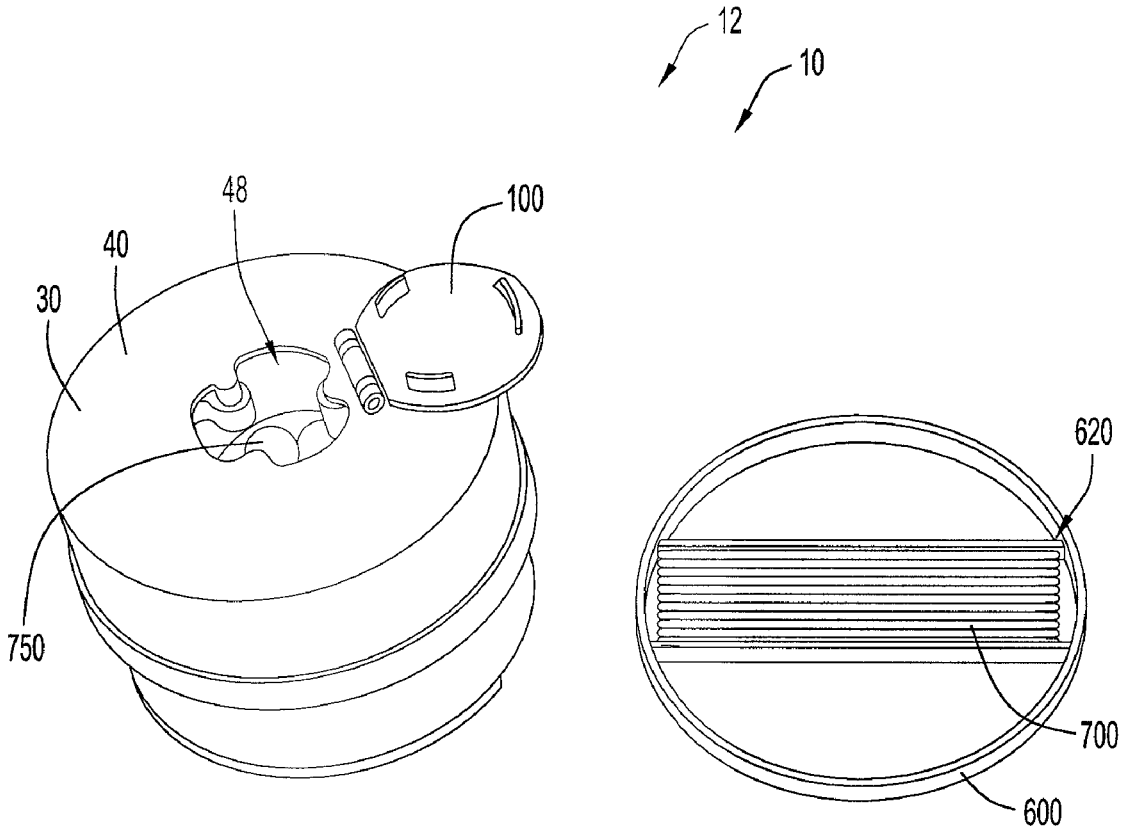
FIG. 2 illustrates a perspective view of the housing illustrated in FIG. 1A with its lid opened and its bottom cover removed.

Referring to FIG. 2, lids 100 and 600 have been moved from their closed positions illustrated in FIG. 1A to their opened positions. The housing 10 is still in its collapsed configuration 12 in FIG. 2. Lid 100 is pivotally coupled to the upper housing portion 30 and can be pivoted to allow access to an opening 48 that is defined in a body portion 40 of the upper housing portion 30. The opening 48 is sized to permit objects 750, such as small balls, to be inserted therethrough. As shown in FIG. 2, objects 750 can be stored inside the housing 20 when the housing 20 is in its collapsed configuration 14. The lid 100 can be closed to keep the objects 750 contained therein.

As shown in FIG. 2, bottom lid or cover 600 includes an area 620 in which several elongate members 700 can be placed. When lid 100 is coupled to housing portion 500, the members 700 are stored and maintained therein.

Figure 3:
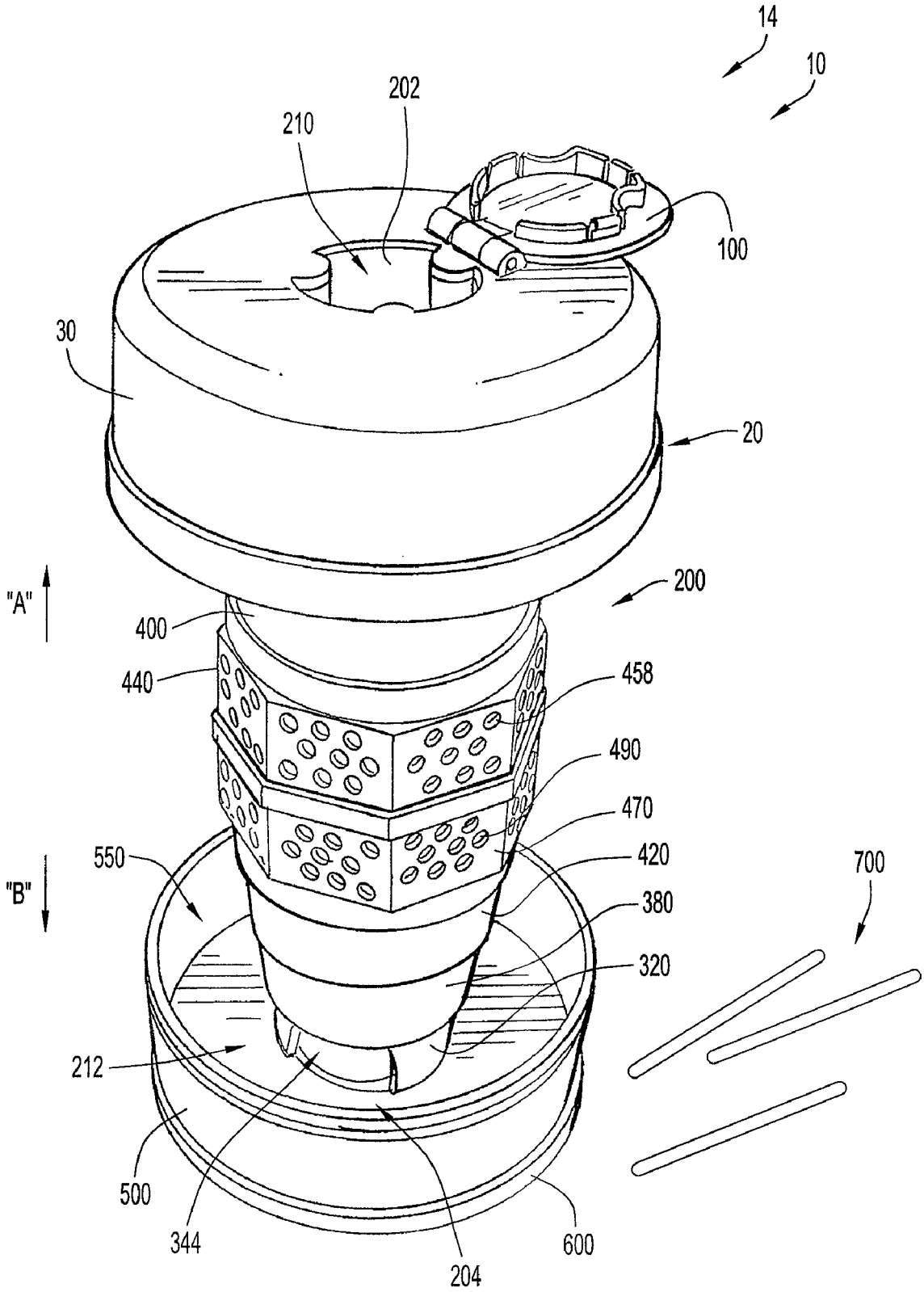
FIG. 3 illustrates a perspective view of the housing illustrated in FIG. 1A in a deployed configuration.

When the housing 20 is in its collapsed configuration 12, forces can be applied to the upper housing portion 30 along the direction of arrow "A" and to the lower housing portion 500 along the direction of arrow "B" (see FIG. 3). The movement results in the housing 20 moving to its deployed configuration.

Referring to FIG. 3, the housing 20 is illustrated in its deployed configuration 14 in which a game can be played using the housing 20. In this configuration 14, the upper housing portion 30 and the lower housing portion 500 are spaced apart and maintained in these positions by a passage portion 200. The passage portion 200 has a first end 210 and a second end 212 opposite to the first end 210. The first end 210 is coupled to the upper housing portion 30 using connectors, such as screws. The second end 212 is similarly coupled to the lower housing portion 500 using connectors, such as screws. The locations of the inlet 202 and the outlet 204 of the passage portion 200 are illustrated in FIG. 3.

Figure 4A:
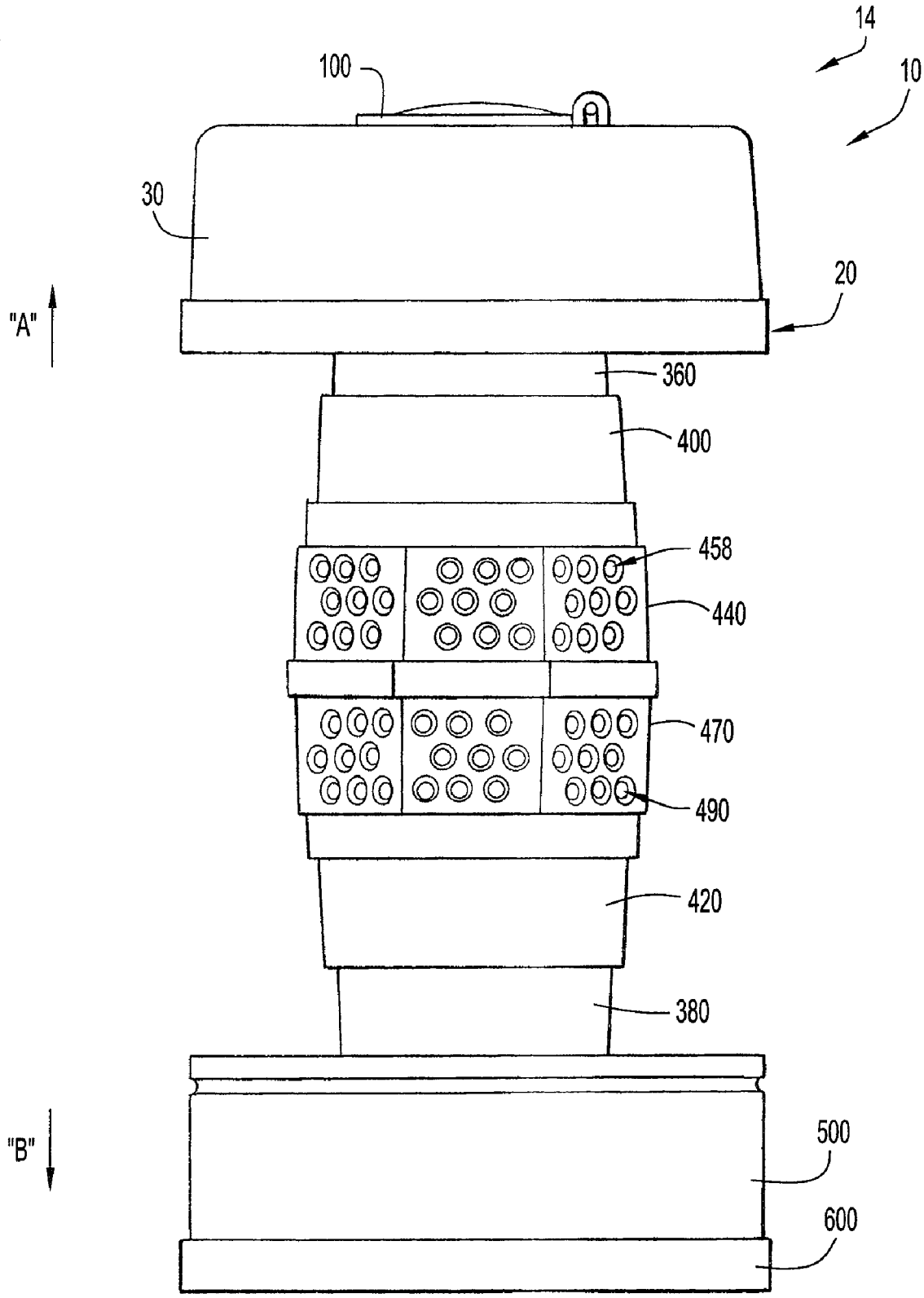
FIG. 4A illustrates a side view of the housing illustrated in FIG. 3.
Figure 4B:
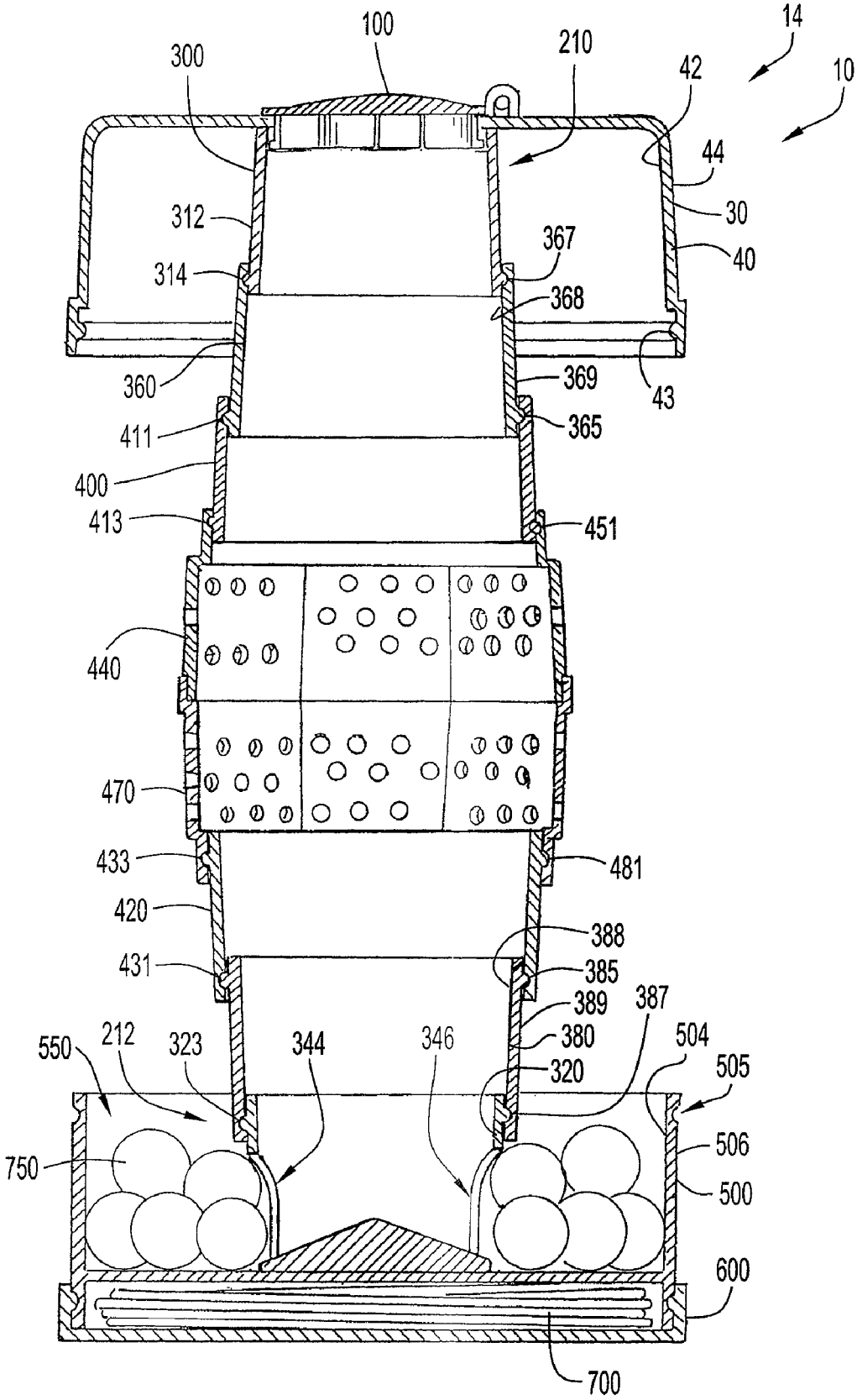
FIG. 4B illustrates a cross-sectional side view of the housing illustrated in FIG. 3.
Figure 4C:
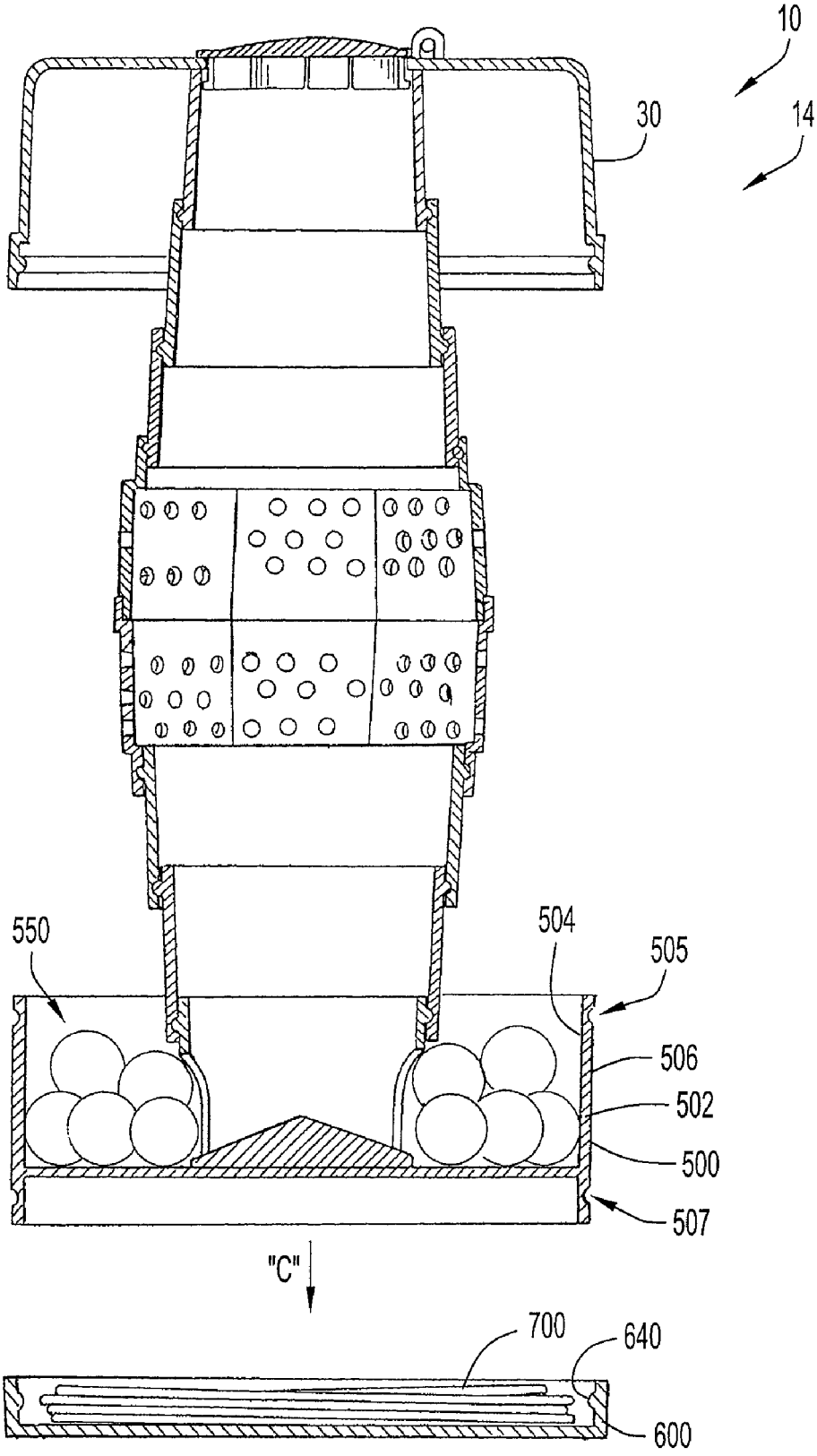
FIG. 4C illustrates a cross-sectional side view of the housing illustrated in FIG. 3 with the lid removed.

Referring to FIGS. 3 and 4A-4E, the passage portion 200 includes several sections that are coupled to adjacent sections in series. The sections are best illustrated in FIG. 4B which is a cross-sectional side view of the game 10. Each of the sections includes a wall that has an inner surface that defines a channel extending through the particular section. The channels defined by the sections collectively form a channel that extends from the first end 210 to the second end 212 of the passage portion 200.

In one embodiment, the passage portion 200 includes sections 300 and 320 that are coupled to the upper housing portion 30 and the lower housing portion 500, respectively (see FIG. 4B). The passage portion 200 also includes sections 360 and 380 that are engaged with sections 300 and 320, respectively, in a telescopic manner and sections 400 and 420 that are engaged with sections 360 and 380, respectively, in a telescopic manner. The passage portion 200 also includes engagement sections 440 and 470 that are fixedly coupled to each other and that receive sections 400 and 420 in a telescopic manner. The sections are sized so that with the exception of the middle two sections, each of the other sections slides inside of another section, thereby facilitating the collapsing of the product.

When the housing portions 30 and 500 are pulled apart, the movable sections of the passage portion 200 slide relative to each other and are locked in their extended positions shown in FIG. 3. The locking of the sections is accomplished by coupling mechanisms that snap the sections in place relative to each other. As described relative to FIG. 22 below, the coupling mechanisms include a rib or ridge on one or more sections that is engaged by a lip on another section to provide a positive lock between the sections. As a result, more than just friction retains the sections in their deployed positions. The snapping connection between adjacent sections provides a more stable support in the deployed configuration.

Figure 4D:
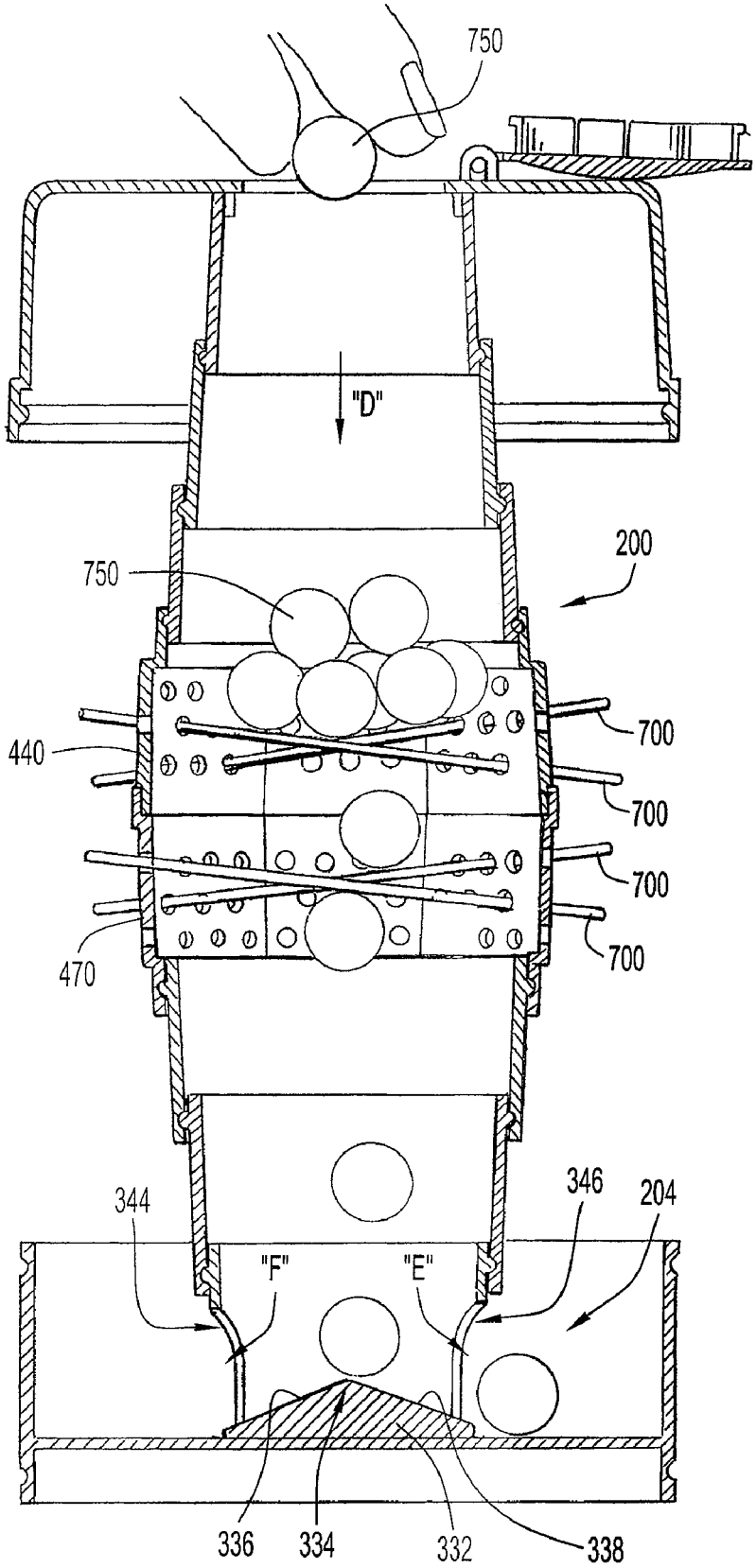
FIG. 4D illustrates a cross-sectional side view of the housing illustrated in FIG. 3 in use.
Figure 4E:
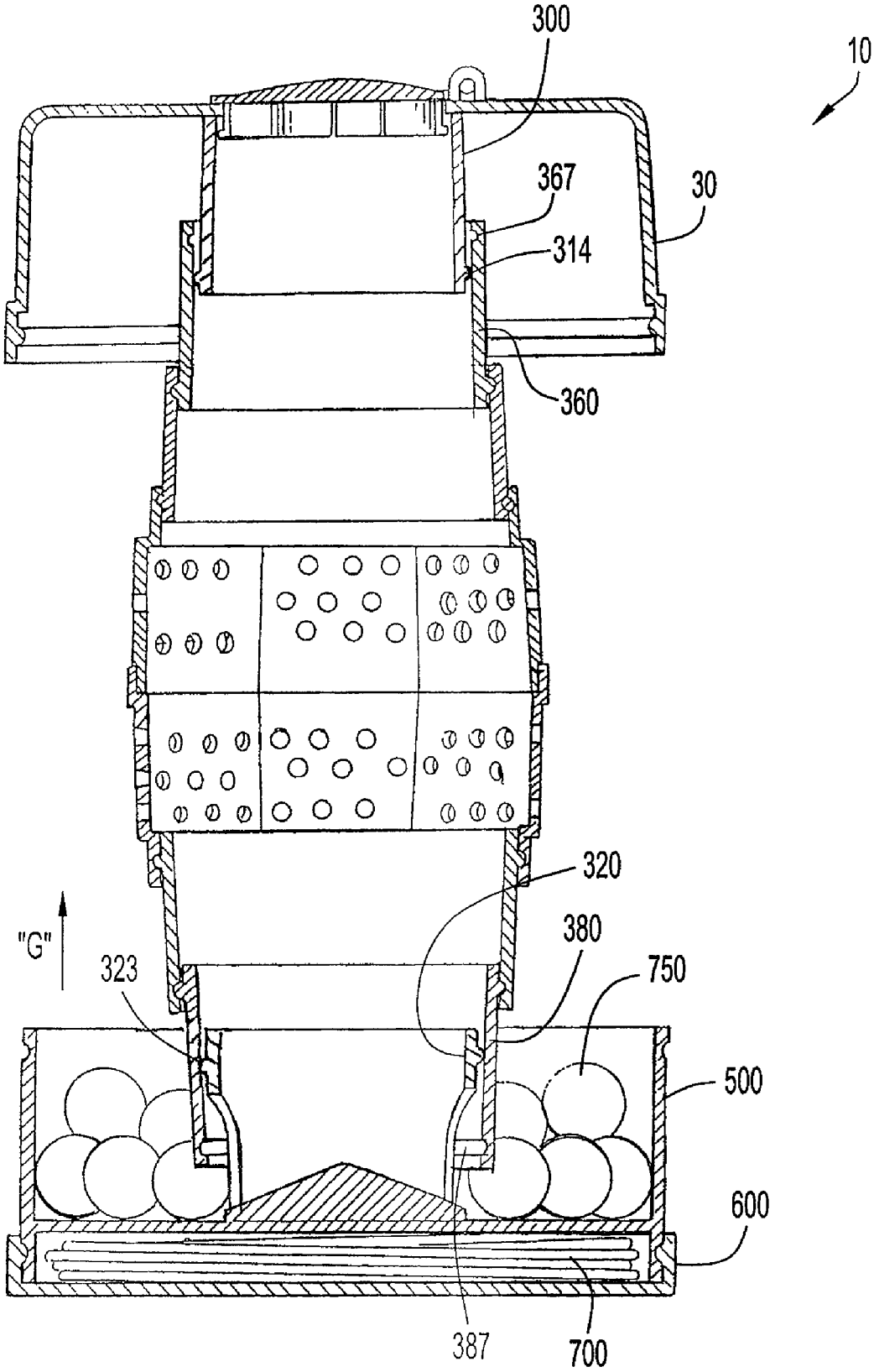
FIG. 4E illustrates a cross-sectional side view of the housing illustrated in FIG. 3 being collapsed.

Referring to FIGS. 4B and 4E, the snapping or coupling between the different sections in this embodiment is illustrated. Referring to FIG. 4B, the game 10 is illustrated in its deployed or use configuration 14. The sections are described from the top to the bottom in the configuration. As shown, upper connector section 300 includes an outer surface 312 with a ridge or lip 314 formed thereon. The ridge 314 can engage a groove 367 formed on the inner surface 368 of section 360. The engagement of the ridge 314 with the groove 367 maintains the sections 300 and 360 in their deployed positions. Similarly, section 360 includes a ridge 365 on its outer surface 369 that can engage a groove 411 formed on the inner surface of section 400. In addition, section 400 includes a ridge 413 that can engage a groove 451 formed on the inner surface of the section 440.

The lower connector section 320 has a ridge 323 located on its outer surface. The ridge 323 can engage the groove 387 on section 380. Similarly, section 380 includes its own ridge 385 on its outer surface that can engage the groove 431 formed on the inner surface of section 420. Also, section 420 can include a ridge 433 formed on its outer surface that can engage with the groove 481 of section 470. When the ridges on the sections engage the corresponding grooves on the adjacent sections, the structure defining the passageway 200 is maintained in its deployed configuration as shown.

In addition, the upper cap 30 and the lower cap 500 can be releasably coupled together in the collapsed configuration of the game 10 via the ridge 43 that is formed along the inner surface 42 of the cap 30 and the groove 505 that is formed along the outer surface 506 of the lower cap 500.

Referring to FIG. 4E, the game 10 is illustrated in a partially collapsed configuration in which the lower cap 500 is moved by a user along the direction of arrow "G." Provided that the force applied by the user along the direction of arrow "G" is sufficient, one or more of the ridges disengages from its corresponding groove. For example, in FIG. 4E, ridge 314 of section 300 has disengaged from groove 367 and slides along the inner surface of section 360 as force is continued to be applied to the lower cap or housing 500. Similarly, ridge 323 on section 320 has disengaged from groove 387 on section 380. As the user continues to apply a force to collapse the game 10, the other ridges disengage from the grooves in a similar manner. In various uses, the particular order in which the ridges disengage from the grooves in adjacent sections can vary.

Referring back to FIGS. 4B and 4C, the objects 750 are located in a collecting area 550 formed in the lower cap or housing 500. The lid 600 in which the sticks or elongate members 700 are stored can be decoupled from the lower cap or housing 500 along the direction of arrow "C." The lid 600 can be coupled to the lower housing 500 via the engagement of the ridge 640 on the inner surface of the lid 600 with the groove 507 on the outer surface of the lower housing 500.

In FIG. 4D, the game 10 is illustrated as being in use. There are many different ways in which the sticks 700 and objects 750 can be used with the game 10. In the configuration shown in FIG. 4D, a user has inserted the sticks 700 into the openings in sections 440 and 470. The user can drop the objects 750 along the direction of arrow "D" into the opening at the top of the passage portion 200 and the objects 750 can engage the inserted sticks 700 or pass through the passage portion 200 and engage the divider 332.

As shown in FIGS. 3 and 4A, sections 440 and 470 have several openings 458 and 490, respectively, formed therein. Each of the openings 458 and 490 is sized to receive an elongate member 700 that is extended into an opening on one side of a section and the corresponding opening on the opposite side of the section. The elongate members 700 extend through the channel defined by the passage portion 200 and function as an impediment in the channel.

When the lid 100 is pivoted to an opened position, objects 750 can be dropped into the opening 48 in the housing portion 30 which is in communication with an inlet at the upper end 210 of the passage portion 200. In one embodiment, the inlet of the passage portion 200 is larger than the opening 48 in the upper housing portion 30. The objects 750 can travel along the passage portion 200 unless the elongate members 700 impede the progress of the objects 750 as described in detail below regarding game play. If the objects 750 travel past the elongate members 700, the objects 750 then travel through sections 380 and 420 and out one of the outlets (only outlet or opening 344 is shown in FIG. 3) in section 320 and into the receptacle 550.

Referring to FIGS. 3 and 4D, the lower portion of the passage portion 200 is illustrated. Sections 320, 380, 420, and 470 are shown. Lower connector section 320 includes an internal divider 332, as described in detail below, and outlets or openings 344 and 346 on opposite sides of the section 320. The divider 332 includes a ridge 334 that is located substantially in the center of the divider 334. The divider also includes guide surfaces 336 and 338. When an object 750 contacts the divider 332, it contacts either surface 336 or surface 338 and moves along the direction of either arrow "E" or arrow "F" and exits the corresponding one of the outlets 344 and 346 and moves into the receptacle 550 defined by the lower housing portion 500.

Figure 5:
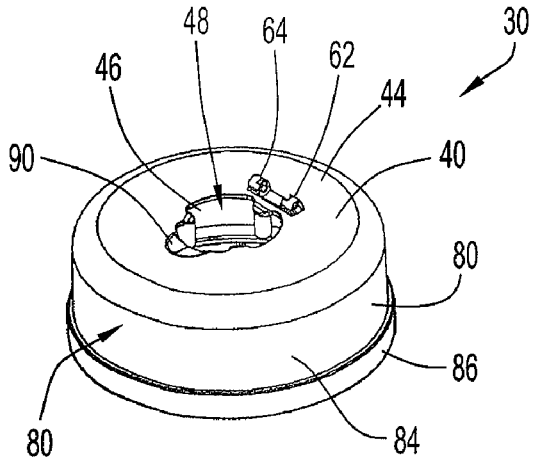
FIG. 5 illustrates a top perspective view of a housing portion of the housing illustrated in FIG. 1A.
Figure 6:
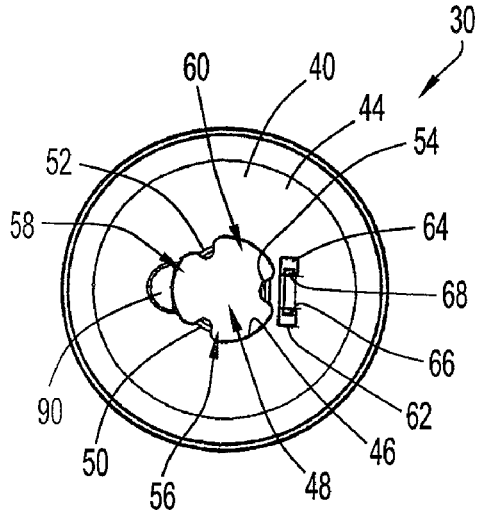
FIG. 6 illustrates a top view of the housing portion illustrated in FIG. 5.
Figure 7:
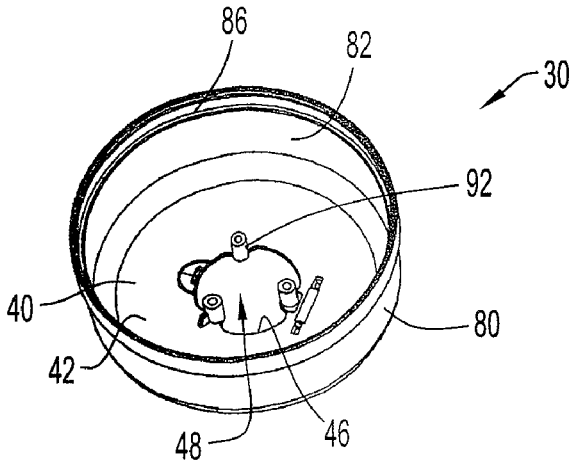
FIG. 7 illustrates a bottom perspective view of the housing portion illustrated in FIG. 5.

Referring to FIGS. 5-7, an embodiment of the upper housing portion 30 is illustrated. As illustrated in FIG. 5, the upper housing portion 30 includes a body portion 40 with an outer surface 44 and an edge 46 that defines an opening 48 extending through the body portion 40. As shown in FIGS. 5 and 6, the edge 46 defining the opening 48 includes several projections 50, 52, and 54 located around the perimeter of the opening 48. Between the projections 50, 52, and 54 are recesses 56, 58, and 60 into which tabs on the lid 100 are inserted when the lid 100 is moved to its closed position.

The upper housing portion 30 includes a mounting structure that has shoulders 62 and 64 (see FIGS. 5 and 6) that define recesses 66 and 68 into which a connector such as a pin can be inserted. The pin is inserted through an opening in the lid 100, as described in detail below, and the recesses 66 and 68 to pivotally mount the lid 100 to housing portion 30. The pivotal mounting enables easy movement of the lid 100 when access to opening 48 is desired. In addition, the opening 48 can be closed by lid 100 to keep items inside.

As shown in FIGS. 5 and 6, a recess or recessed area 90 is formed in the outer surface of the body portion 40. The recess 90 allows a user to insert a finger between a portion of the lid 100 and the housing portion 30 to lift the lid 100 from its closed position. The recess 90 is formed or defined by a curved surface portion as shown.

Referring to FIG. 7, several bosses or mounting structures 92 are located on the inner surface 42 of the body portion 40 of cap 30. The structures 92 receive connectors such as screws that are used to couple section 300 of passage portion 200 to the cap 30. The cap 30 also includes a side portion 80 with an inner surface 82 and an outer surface 84. The side portion 80 includes a ridge portion 86 that has a slightly larger diameter to receive a portion of the lower cap 500.

Figure 8:
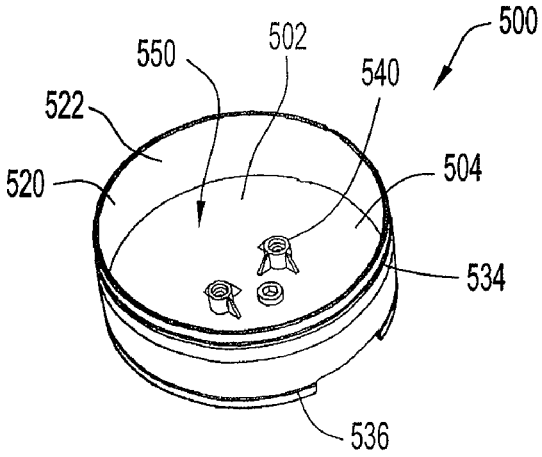
FIG. 8 illustrates a top perspective view of another housing portion of the housing illustrated in FIG. 1A.
Figure 9:
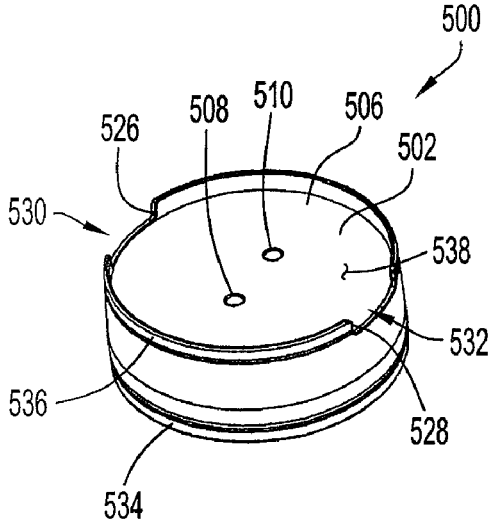
FIG. 9 illustrates a bottom perspective view of the housing portion illustrated in FIG. 8.

Referring to FIGS. 8 and 9, the lower cap 500 includes a body portion 502 and a side portion 520 extending around the body portion 502. The portion 502 and 520 collectively define a receptacle 550. The body portion 502 includes an inner surface 504 (see FIG. 8) and an outer surface 506 (see FIG. 9). Openings 508 and 510 extend through the body portion 502 for connectors to couple section 320 to lower cap 500. Mounts 540 on the inner surface 504 are used to couple to lower section 320.

The side portion 520 also includes an inner surface 522 and an outer surface 524. As shown in FIG. 9, the side portion 520 extends beyond the body portion 502 and includes a pair of recesses 530 and 532 that are located opposite to each other and defined by edges 526 and 528, respectively. The recesses 530 and 532 are discussed below relative to cover 600. The outer surface 524 includes grooves 534 and 536 formed in the upper end and lower end of the side portion 520, respectively, as shown in FIGS. 8 and 9. The side portion 520 defines a storage area 538 that is configured to receive a portion of the lower cover 600 and objects contained by the cover 600.

Figure 10:
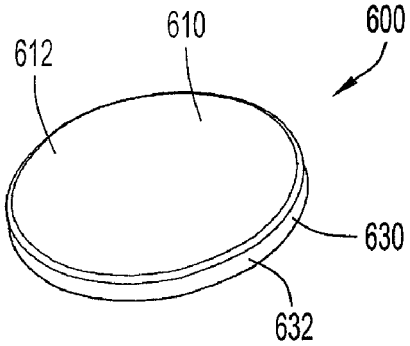
FIG. 10 illustrates a bottom perspective view of the bottom cover of the housing illustrated in FIG. 1A.
Figure 11:
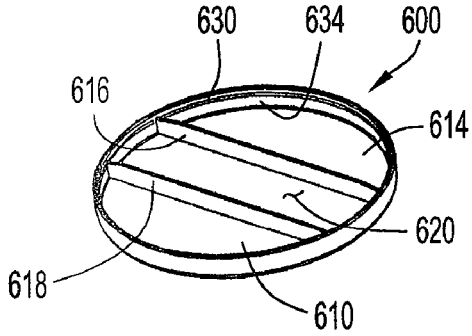
FIG. 11 illustrates a top perspective view of the bottom cover of the housing illustrated in FIG. 10.

Referring to FIGS. 10 and 11, the lid 600 includes a body portion 610 with an outer surface 612 and an inner surface 614 and a side portion 630 that extends around the perimeter of the body portion 610. A pair of plates 616 and 618 extends across the lid 600 between different parts of the side portion 630. The plates 616 and 618 and side portion 630 define an area or receptacle 620 therebetween. The area 620 is configured to receive the elongate members 700 as illustrated in FIG. 2. The side portion 630 has an outer surface 632 and an inner surface 634. The inner surface 634 has a groove formed therein that receives part of lower housing portion 500.

Figure 12:
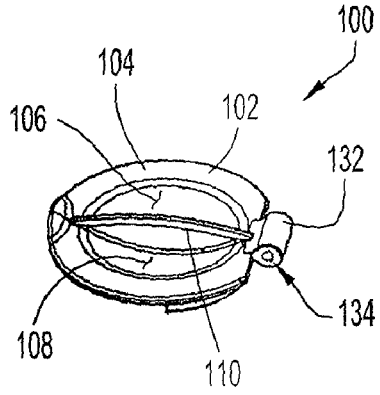
FIG. 12 illustrates a top perspective view of the lid of the housing illustrated in FIG. 1A.
Figure 13:
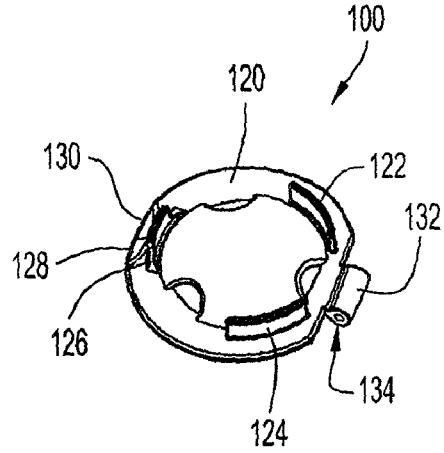
FIG. 13 illustrates a bottom perspective view of the lid illustrated in FIG. 12.
Figure 14:
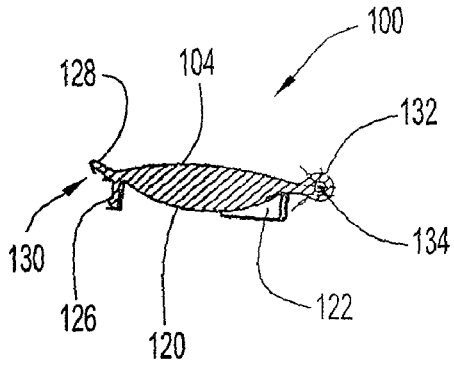
FIG. 14 illustrates a cross-sectional view of the lid illustrated in FIG. 12.

Referring to FIGS. 12-14, an embodiment of the lid 100 is illustrated. The lid 100 includes a body portion 102 and a mounting portion 132 integrally formed with the body portion 102. In this embodiment, the body portion 102 has an outer surface 104 with recesses 106 and 108 formed therein. The body portion 102 also includes a plate 110 located between the recesses 106 and 108. The recesses 106 and 108 permit a user to grasp the plate 110 and move the lid 100 in a desired direction. The mounting portion 132 includes a channel 134 therethrough to receive a connector, such as a pin, to mount the lid 100 to the upper cap 30.

As shown in FIG. 13, several tabs 122, 124, and 126 are integrally formed with the body portion 102 and extend downwardly from an inner surface 120 for engagement with recesses 60, 56, and 58, respectively, of the opening 48 in the upper cap 30. In one embodiment, each of the tabs 122, 124, and 126 may include a lip or ridge that enhances the positive engagement between the lid 100 and the upper cap 30 to maintain the lid 100 in its closed position.

Referring to FIG. 14, the body portion 104 includes a lip 128 that is curved so that it forms recess 130. Recess 130 and recess 90 formed in the upper cap 30 enable a user to insert a finger between the lid 100 and the upper cap 30 to lift upwardly the lid 100. This arrangement facilitates the movement of the lid 100.

Figure 15:
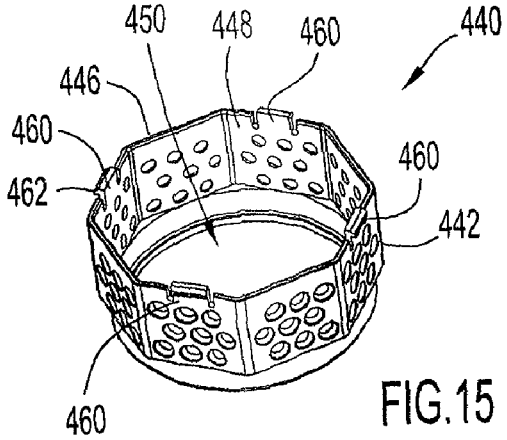
FIG. 15 illustrates a bottom perspective view of a section of the passage portion of the housing illustrated in FIG. 1A.
Figure 16:
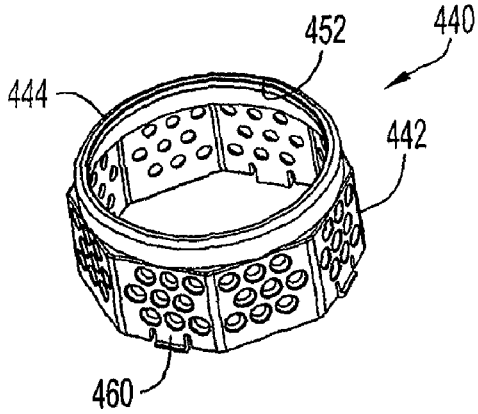
FIG. 16 illustrates a top perspective view of the section illustrated in FIG. 15.
Figure 17:
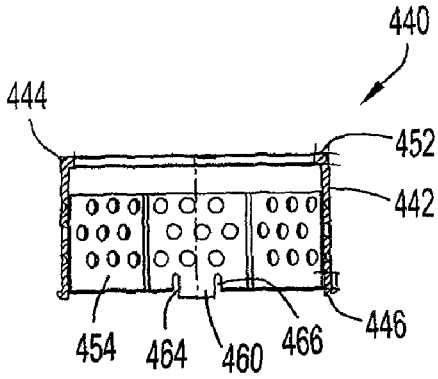
FIG. 17 illustrates a cross-sectional view of the section illustrated in FIG. 15.

Referring FIGS. 15-17, an embodiment of a section of the passage portion is illustrated. In this embodiment, the section 440 includes a wall 442 with opposite ends 444 and 446 and several wall sections 454 with openings 458 located around the perimeter of the section 440. The wall 442 includes an inner surface 448 that defines a channel 450 therethrough. As shown in FIG. 17, a lip 452 with a smaller diameter than the main portion of the section 440 is provided proximate to end 444. The lip 452 limits the movement of section 440 relative to an adjacent section so that the sections can telescopingly slide and not disengage from each other. In other words, the diameter of the opening defined by lip 452 is smaller than the outer diameter of a lip formed on an adjacent section. As shown, some of the wall sections 454 include notches 464 and 466 that define a tab 460 that includes a ridge 462. The tab 460 is used to couple section 440 to section 470 as described below.

Figure 18:
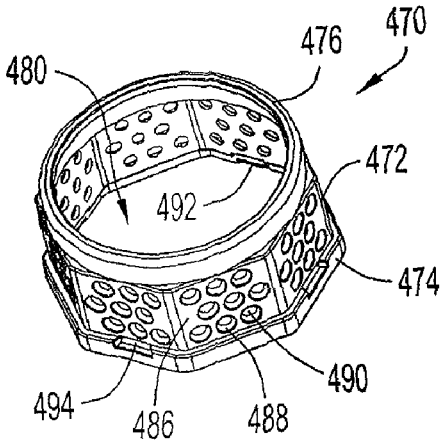
FIG. 18 illustrates a bottom perspective view of another section of the passage portion of the housing illustrated in FIG. 1A.
Figure 19:
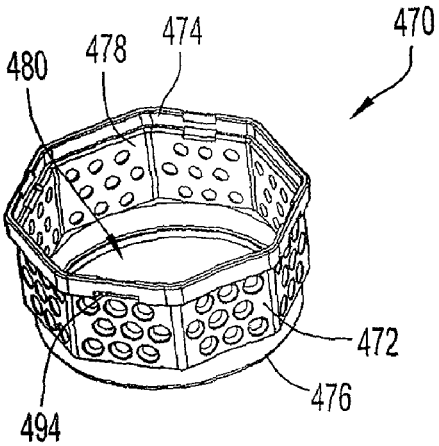
FIG. 19 illustrates a top perspective view of the section illustrated in FIG. 18.
Figure 20:
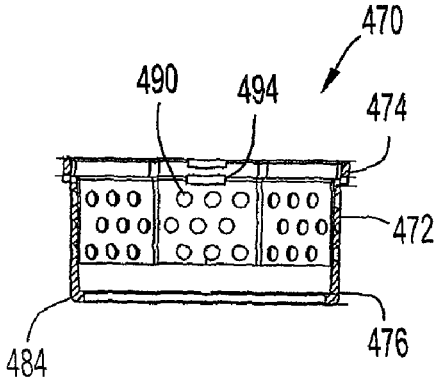
FIG. 20 illustrates a cross-sectional view of the section illustrated in FIG. 18.

Referring to FIGS. 18-20, an embodiment of another section of the passage portion is illustrated. This section 470 positively engages section 440 and when together, sections 440 and 470 are fixed in length and located in the middle of passage portion 200. Section 470 is constructed similar to section 440 with slight differences. Section 470 includes a wall 472 with ends 474 and 476 and an inner surface 478 defining a channel 480 extending therethrough. A lip 484 is formed at one end of the section 470. The section 470 also includes wall sections 486 with spaced apart openings 490. Section 470 also includes several engagement features that cooperate with tabs 460 on section 440 to couple sections 440 and 470 together. The engagement features on section 470 include a groove 492 (see FIG. 18) and a slot or opening 494 (see FIGS. 18 and 20). Each tab 460 on section 440 is inserted into a groove 492 and the ridge 462 engages the corresponding opening 494. As a result, sections 440 and 470 do not move relative to each other.

Figure 21:
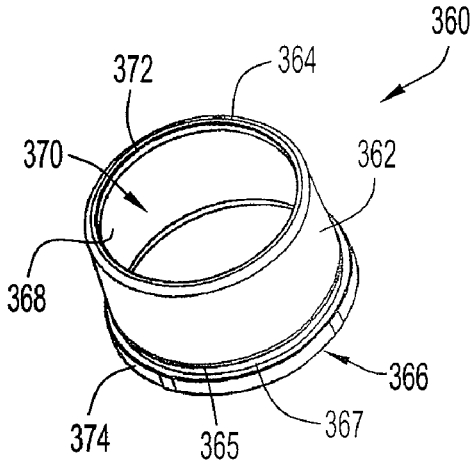
FIG. 21 illustrates a top perspective view of another section of the passage portion of the housing illustrated in FIG. 1A.
Figure 22:
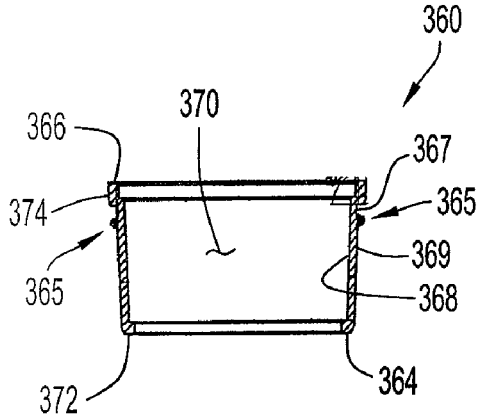
FIG. 22 illustrates a cross-sectional view of the section illustrated in FIG. 21.

Referring to FIGS. 21 and 22, section 360 is illustrated and described. Section 360 is exemplary of many of the other sections in the passage portion 200. As illustrated, section 360 includes a wall 362 with ends 364 and 366, an inner surface 368 that defines a channel 370, and an outer surface 369. An inner lip 372 and an outer lip 374 are formed on the wall 362 for engagement with adjacent sections.

As shown, extending outwardly from the outer surface 369 of the wall 362 is a ridge or rib 365. In FIGS. 21 and 22, the ridge or rib 365 is illustrated in an alternative location on the section as compared to the location shown in FIGS. 4A-4E. The ridge 365 and lip 374 collectively define a groove 367 therebetween. The groove 367 receives the inwardly directed lip (such as lip 372) of an adjacent section 400 and positively retains the lip therein. As a result, sections 360 and 400 are maintained in their extended positions relative to each other. Similar to section 360, each of the other sections 300, 400, 320, 380, and 420 includes a rib or ridge on the outer surface of its wall which receives and retains an inwardly directed lip of an adjacent section. Thus, the sections are retained in their deployed positions as shown in FIG. 3 by the coupling mechanisms, including the ridge and groove, of the sections which provide a snap fit or connection. A player may provide sufficient force to the housing 20 to overcome the coupling mechanisms and move the lips of the sections out of the grooves and over the ridges, thereby collapsing the passage portion 200.

Figure 23:
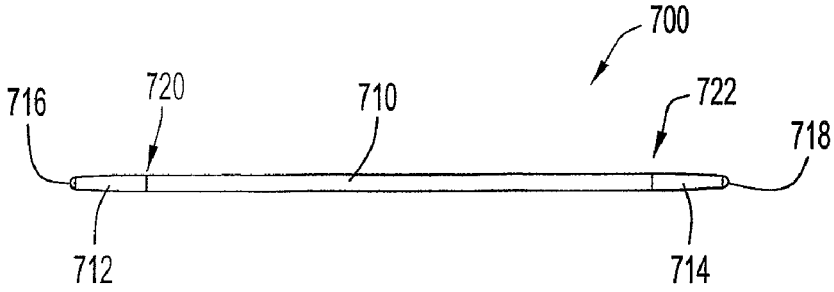
FIG. 23 illustrates a side view of an embodiment of an elongate member.

Referring FIG. 23, an embodiment of an insertable member, which can be referred to as a stick or rod, is illustrated. In this embodiment, the insertable member is an elongate member 700 with a body 710 that is substantially cylindrical. The body 710 has opposite end portions 712 and 714 with ends 716 and 718, respectively. Each of the end portions 712 and 714 are slightly tapered, such as, for example, by an angle of 3.3° in one embodiment. However, in other embodiments, the amount of tapering can vary. The tapered end portions 712 and 714 facilitate the insertion of the elongate members 700 into openings on sections 440 and 470.

Located on the body 710 are engagement members 720 and 722. In this embodiment, the engagement members 720 and 722 are edges that extend around the perimeter of the body 710 and are formed by the tapered end portions 712 and 714.

When the elongate member 700 is inserted into corresponding openings 458 on section 440 or corresponding openings 490 on section 470, either or both of the engagement members 720 and 722 contact the edges defining the openings 458 or 490, thereby reducing the likelihood that the elongate member 700 moves or slides out of engagement from the sections 440 and 470. Elongate members 700 included with game 10 may be one of several different colors, such as either yellow, red, or green.

In an alternative embodiment, the engagement members 720 and 722 can be ribs or ridges that extend outwardly beyond the outer diameter of the body 710. In other embodiments, the engagement members 720 and 722 may extend around only a portion of the perimeter of the body 710. Alternatively, the body 710 may include only one engagement member 720 or 722. In yet other embodiments, the cross-sectional shape or configuration of the body 710 may be different than a circle.

Figure 23A:
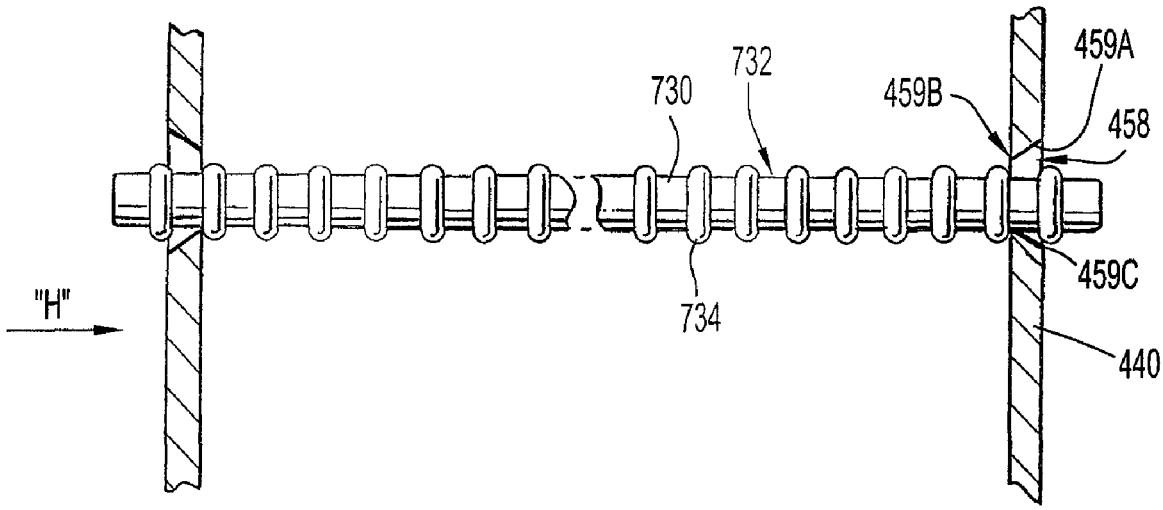
FIG. 23A illustrates a view of another embodiment of an elongate member that has been inserted into a section of the game.

Referring to FIG. 23A, a side view of an alternative embodiment of an elongate member is illustrated. In this embodiment, the elongate member 730 has an outer surface 732 with several ribs 734 formed thereon. The elongate member 730 can be inserted into an opening 458 formed in the section 440 along the direction of arrow "H." As shown, in this embodiment, the opening 458 is defined by an angled surface 459A that forms an edge 459B with the inner surface of section 440 and another edge 459C with the outer surface of section 440. The tapered or angled orientation of the surface 459A facilitates the insertion of the elongate member 730 into the opening 458. When the elongate member 730 is inserted into the openings 458, one or more of the ribs 734 engages the edges 459B, thereby maintaining the elongate member 730 in its inserted position in the section 440. Any number of elongate members 730 can be inserted into sections 440 and 470 as desired.

Figure 24:
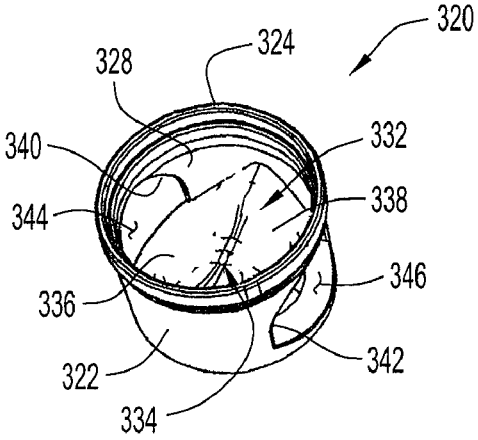
FIG. 24 illustrates a top perspective view of another section of the passage portion of the housing illustrated in FIG. 1A showing the divider.
Figure 25:
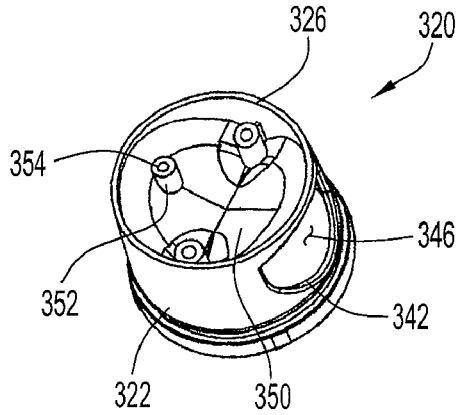
FIG. 25 illustrates a bottom perspective view of the section illustrated in FIG. 24.
Figure 26:
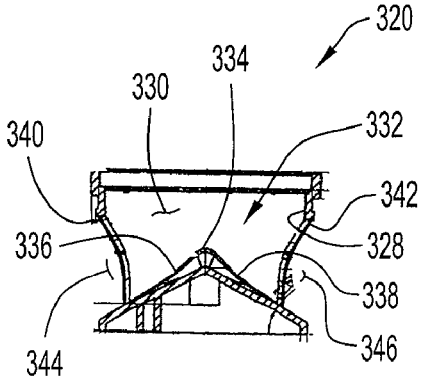
FIG. 26 illustrates a cross-sectional side view of the section illustrated in FIG. 24.

Referring to FIGS. 24-26, the lowest section of the passage portion 200 is illustrated. In this embodiment, the lowest section 320 is coupled to the lower cap 500. Section 320 has a lower surface 350 (see FIG. 25) from which mounts 352 with openings 354 extend. The openings 354 receive connectors, such as screws, that extend through openings in the lower cap 500 to couple section 320 to lower cap 500.

In this embodiment, section 320 includes a wall 322 with opposite ends 324 and 326 and an inner surface 328 that defines a channel 330. Section 320 includes a divider or dividing portion 332 with a ridge 334 that is located in the pathway of objects inserted into the passage portion 200.

Referring to FIG. 26, a cross-sectional side view of section 320 is illustrated. The divider 332 includes surfaces 336 and 338 that are located on opposite sides of ridge 334. When an object 750 contacts the ridge 334 and/or one of the surfaces 336 or 338, the object 750 is directed to one of the two openings 344 or 346 that are defined by edges 340 or 342, respectively. The openings 344 and 346 are the outlets for the passage portion 200 and are in communication with the receptacle or collecting area 550 defined by the lower cap 500.

In an alternative embodiment, the divider 332 may include three or more surfaces formed thereon and a corresponding quantity of openings formed in the wall 322 that are outlets for the passage portion 200.

Now an exemplary usage of the game 10 is described. The object of the game is to pull out the elongate members or sticks 700 during a player's turns and cause the fewest objects 750 to drop as possible. Initially, a player pulls apart on the upper housing portion or cap 30 and the lower housing portion or cap 500. The sections of the passage portion 200 slide relative to each other to their extended positions as shown in FIG. 3. The snap contact/engagement of the sections retain the housing 20 in a deployed configuration 14.

The elongate members 700 are inserted into aligned pairs of openings in sections 440 and 470. The elongate members 700 can be placed at random through sections 440 and 470. The lid 100 can be opened relative to the cap 30, providing the player with access to the opening 48. A player can insert a finger or other object into the recesses 90 and 130 between the upper cap 30 and the lid 100 to facilitate the opening of the lid 100.

After the members 700 have been inserted, the user can then drop the objects 750 into the opening 48 and the inlet of the passage portion 200. If any objects 750 fall through the elongate members 700 and into receptacle 550, a player can drop those objects 750 into the opening 48 again. When the objects 750 are retained on the upper side of the elongate members 700 that extend through the passage portion 200, game play commences.

If there are multiple players, one player is chosen to go first. Play continues to successive players in the order as determined by the players. The first player chooses an inserted elongate member 700 and pulls that member 700 out of the passage portion 200. In one method of game play, the first elongate member 700 that the player touches is the member 700 that the player must pull. The player pulling the member 700 tries to do so without moving any objects 750 and causing them to fall down past the remaining elongate members 700. If one or more objects 750 fall down, they will engage the divider 332 and exit through outlet 344 or outlet 346 of the passage portion 200.

When the member 700 is pulled out by the player, the player's turn is over and the player has to take any objects 750 that exited the passage portion 200 and into the receptacle 550 of lower cap 500.

The next player then chooses an elongate member 700 to pull and the game continues. The prior player's turn is over when the next player touches an elongate member 700 or any part of the game 10. If any additional objects 750 drop before the next player touches the game 10 or a member 700, then those objects 750 are added to the prior player's score.

The game continues until all of the objects 750 have fallen off the elongate members 700. When all of the objects 750 have fallen, each of the players counts how many objects 750 are assigned to that player. The player with the fewest objects 750 is the winner.

When the game is finished, any remaining elongate members 700 are removed and the upper housing portion 30 pressed downwardly to overcome the snapped arrangement of adjacent sections of the passage portion 200. The sections slide within each other as previously described, thereby enabling the upper housing portion 30 to contact and engage the lower housing portion 500. In one embodiment, a ridge is formed on at least one of the portions 30 or 500 and engaged by the other portion 30 or 500 to couple the portions 30 and 500 together so that the game 10 is in its collapsed configuration.

The elongate members 700 can be placed in area 620 of lid 600 and the lid 600 can be snapped onto the bottom of the lower housing portion 500. The plates 616 and 618 align with the notches 530 and 532 when the lid 600 is coupled to housing portion 500.

The lid 100 can be opened by a user and the objects 750 can be inserted into the opening 48 in the upper housing portion 30. The opening 48 is in communication with the channel of the passage portion 200. Accordingly, when the objects 750 are inserted into the opening 48, the objects 750 remain in the collapsed sections of the passage portion 200 which helps with the storage of the objects 750 when the game 10 is in its collapsed configuration 12. The lid 100 can be moved to its closed position in which it is retained by the tabs 122, 124, and 126. The closed lid 100 enables a user to maintain the objects 750 in the housing 20 when the game 10 is in its collapsed configuration 12.

In variations in game play, users can be assigned one of the colors of the elongate members and have to pull the particular colored elongate members during that player's turns.

The various components of the game 10 are formed of molded plastic. In various embodiments, the quantity of elongate members and objects to be dropped into the game can vary. Also, the features of the objects 750, such as size, shape, color, etc., can vary.

While the invention has been described in detail and with reference to specific embodiments thereof, it will be apparent to one skilled in the art that various changes and modifications can be made therein without departing from the spirit and scope thereof. Thus, it is intended that the present invention covers the modifications and variations of this invention provided they come within the scope of the appended claims and their equivalents. For example, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration.

What is claimed is:

1. A game, comprising:

a reconfigurable housing including:

a first cap including a body defining an opening therethrough;

a second cap defining a receptacle; and a passage portion having a first end, a second end, a first section, and a second section coupled to the first section in a telescopic arrangement, the first end being coupled to the first cap and the first section and the second end being coupled to the second cap and the second section, the passage portion being reconfigurable between a collapsed configuration and a deployed configuration, one of the first section and the second section being configured to provide a snap fit when the first section and the second section are moved to extended positions, the snap fit retaining the first section and the second section in their extended positions and the passage portion in the deployed configuration, the passage portion defining a channel in communication with the opening in the first cap, and having a first outlet and a second outlet, each of the outlets being in communication with the receptacle of the second cap;

at least one elongate member configured to be inserted into and supported by the passage portion, the at least one elongate member extending into the channel; and at least one object configured to be inserted into the opening of the first cap, the at least one object traveling from the opening in the first cap, through the channel of the passage portion, and out one of the outlets into the receptacle of the second cap.

2. The game of claim 1, wherein the first cap includes a lid movably coupled to the body of the first cap, the lid being positionable to cover the opening.

3. The game of claim 2, wherein the first cap includes a recess that facilitates movement of the lid relative to the first cap.

4. The game of claim 2, wherein the lid includes a recess that facilitates movement of the lid relative to the first cap.

5. The game of claim 1, wherein the passage portion includes a divider located between the first outlet and the second outlet.

6. The game of claim 5, wherein the divider includes a ridge, a first guide surface, and a second guide surface, the ridge being located between the first guide surface and the second guide surface.

7. The game of claim 6, wherein the first guide surface is located proximate to the first outlet and the second guide surface is located proximate to the second outlet.

8. The game of claim 1, wherein the at least one elongate member includes a body with an engagement member formed thereon, the engagement member contacting part of the passage portion to limit the movement of the at least one elongate member relative to the passage portion.

9. The game of claim 8, wherein the engagement member is a first engagement member and the at least one elongate member includes a second engagement member formed on the body, the second engagement member being spaced apart from the first engagement member.

10. The game of claim 1, wherein the first cap includes a lid pivotally coupled to the body of the first cap, the lid being movable between an opened position and a closed position in which it covers the opening, each of the lid and the body of the first cap including a recess formed therein, the recesses being configured to receive a user's finger.

11. A collapsible game, comprising:

a housing reconfigurable between a collapsed configuration and a deployed configuration, the housing including:

a first housing portion including a body with an opening therethrough, the body having a recess formed therein, the first housing portion having a lid pivotally coupled to the body, the lid having a recess formed therein, the recesses being proximate to each other when the lid is in a closed position relative to the first housing portion;

a second housing portion defining a receptacle; and a passage portion including a wall and having a first end, a second end, a first section, and a second section coupled to the first section in a telescopic arrangement, a first end coupled to the first housing portion and the first section and a second end coupled to the second housing portion and the second section, the passage portion supporting the first housing spaced apart from the second housing when the housing is in its deployed configuration, one of the first section and the second section being configured to provide a snap fit when the first section and the second section are moved to extended positions, the snap fit retaining the first section and the second section in their extended positions and the passage portion it its deployed configuration, the passage portion having a channel in communication with the opening in the first housing portion and extending to an outlet proximate to the second end, the passage portion including a plurality of openings formed in the wall;

at least one elongate member configured to be inserted into one of the openings formed in the wall, the at least one elongate member extending into the channel; and at least one object configured to be inserted into the opening of the first housing portion, the at least one object traveling from the opening in the first housing portion, through the channel of the passage portion proximate to the at least one elongate member, and out of the outlet into the receptacle of the second housing portion.

12. The game of claim 11, wherein each of the recesses is configured to be engaged by a finger of a user.

13. The game of claim 12, wherein the passage portion includes a plurality of sections, each of the sections including a coupling structure that engages an adjacent section and maintains the passage portion in a deployed configuration when the housing is in its deployed configuration.

14. The game of claim 11, wherein the outlet of the passage portion is a first outlet and the passage portion includes a second outlet, each of the first outlet and the second outlet being in communication with the receptacle of the second housing portion such that the at least one object can travel out of either the first outlet or the second outlet into the receptacle of the second housing portion.

15. The game of claim 14, wherein each of the recesses is configured to be engaged by a finger of a user.

16. The game of claim 15, wherein the passage portion includes a divider located proximate to the channel, the divider being configured to direct the at least one object toward the first outlet or the second outlet.

17. The game of claim 15, wherein the divider includes a first guide surface, a second guide surface, and a divider located between the guide surfaces, each of the guide surfaces being oriented toward one of the outlets.

18. A collapsible game, comprising:

an upper housing;

a lower housing;

a passage portion including a first section and a second section coupled to the first section in a telescopic arrangement, the passage portion coupled to the upper housing and to the lower housing, the passage portion being disposable in a deployed configuration and in a collapsed configuration, the passage portion in its deployed configuration having a greater length than in its collapsed configuration, one of the first section and the second section being configured to provide a snap fit when the first section and the second section are moved to extended positions, the snap fit retaining the first section and the second section in their extended positions and the passage portion in its deployed configuration, the passage portion including a first opening proximate to the upper housing, a second opening proximate to the lower housing, and a third opening proximate to the lower housing, the passage portion including a divider located between the second opening and the third opening; and at least one object configured to be inserted into the first opening when the passage portion is in its deployed configuration, engage the divider, and exit the second opening or the third opening.

19. The game of claim 18, wherein the passage portion includes a wall with at least one opening, and the game further comprises:

at least one elongate member insertable into the at least one opening of the wall, the at least one elongate member including a engagement member formed thereon, the engagement member preventing the at least one elongate member from disengaging from the passage portion, the at least one object being engageable with the at least one elongate member when the at least one object moves through the passage portion.

* * * * *